US008596049B2

(12) United States Patent
Isada et al.

(10) Patent No.: US 8,596,049 B2
(45) Date of Patent: Dec. 3, 2013

(54) EXHAUST SYSTEM HAVING AN AFTERTREATMENT MODULE

(75) Inventors: Raymond Upano Isada, Peoria, IL (US); Stephan D. Roozenboom, Washington, IL (US); Rajdeep S. Pradhan, Edwards, IL (US)

(73) Assignee: Caterpillar Inc., Peoria, IL (US)

( * ) Notice: Subject to any disclaimer, the term of this patent is extended or adjusted under 35 U.S.C. 154(b) by 1015 days.

(21) Appl. No.: 12/645,014

(22) Filed: Dec. 22, 2009

(65) Prior Publication Data

US 2011/0146253 A1 Jun. 23, 2011

(51) Int. Cl.
*F01N 3/10* (2006.01)
*F01N 1/00* (2006.01)

(52) U.S. Cl.
USPC ..... 60/302; 60/324

(58) Field of Classification Search
USPC ..... 60/286, 302, 324, 323
See application file for complete search history.

(56) References Cited

U.S. PATENT DOCUMENTS

| | | | | |
|---|---|---|---|---|
| 5,325,666 | A | 7/1994 | Rutschmann | |
| 5,604,980 | A | 2/1997 | Shustorovich et al. | |
| 6,557,341 | B2 | 5/2003 | Bubeck et al. | |
| 6,620,391 | B2 * | 9/2003 | Muller et al. | 423/210 |
| 6,680,037 | B1 | 1/2004 | Allansson et al. | |
| 6,722,124 | B2 | 4/2004 | Pawson et al. | |
| 6,729,127 | B2 | 5/2004 | Woerner et al. | |
| 7,282,185 | B2 | 10/2007 | Harris | |
| 7,293,408 | B2 | 11/2007 | Kohler et al. | |
| 7,328,574 | B2 | 2/2008 | Vignassa et al. | |
| 8,240,133 | B2 * | 8/2012 | Jasinkiewicz et al. | 60/286 |
| 2006/0070375 | A1 * | 4/2006 | Blaisdell | 60/324 |
| 2006/0153748 | A1 | 7/2006 | Huthwohl et al. | |
| 2006/0153761 | A1 | 7/2006 | Bandl-Konrad et al. | |
| 2006/0156712 | A1 | 7/2006 | Buhmann et al. | |
| 2007/0289294 | A1 | 12/2007 | Werni et al. | |
| 2008/0093161 | A1 * | 4/2008 | Winkel et al. | 181/236 |
| 2008/0093163 | A1 | 4/2008 | Frederiksen | |
| 2008/0264048 | A1 | 10/2008 | Nishiyama et al. | |

(Continued)

FOREIGN PATENT DOCUMENTS

| | | |
|---|---|---|
| EP | 1 510 674 | 3/2005 |
| JP | 09-088569 | 3/1997 |

(Continued)

OTHER PUBLICATIONS

Harold Holmes (California EPA), "California's Locomotive Emission Reduction Needs", CARB Locomotive Symposium, Nov. 28, 2007, pp. 1-14.

http://www.businesswire.com/news/google/20090209005879/e, "Detroit Diesel Previews its Blue Tec SCR Technology at TMC,"Feb. 9, 2009, pp. 1-3.

Mobiclean (Hug Engineering), "Soot Particle Filter Systems for mobile diesel engines," pp. 1-4.

(Continued)

*Primary Examiner* — Kenneth Bomberg
*Assistant Examiner* — Jason Sheppard
(74) *Attorney, Agent, or Firm* — Finnegan, Henderson, Farabow, Garrett & Dunner LLP

(57) ABSTRACT

An aftertreatment module for use with an engine is disclosed. The aftertreatment module may have a plurality of inlets configured to direct exhaust in a first flow direction into the aftertreatment module. The aftertreatment module may also have a mixing duct configured to receive exhaust from the plurality of inlets, and a branching passage in fluid communication with the mixing duct. The branching passage may be configured to redirect exhaust from the mixing duct into separate flows that exit the aftertreatment module in a second flow direction opposite the first flow direction.

17 Claims, 5 Drawing Sheets

(56) References Cited

U.S. PATENT DOCUMENTS

| | | | | |
|---|---|---|---|---|
| 2008/0314033 | A1 | 12/2008 | Aneja et al. | |
| 2009/0007551 | A1 | 1/2009 | Wahlstrom et al. | |
| 2009/0101434 | A1* | 4/2009 | Sammut et al. | 181/227 |
| 2009/0158720 | A1 | 6/2009 | Krause et al. | |
| 2010/0089034 | A1* | 4/2010 | Harmsen | 60/276 |

FOREIGN PATENT DOCUMENTS

| | | |
|---|---|---|
| JP | 2008-254572 | 10/2008 |
| JP | 2008-274850 | 11/2008 |
| JP | 2008-274851 | 11/2008 |
| JP | 2009-133228 | 6/2009 |
| WO | WO 02/33234 | 4/2002 |

OTHER PUBLICATIONS

Motive Power (A Wabtec Company), "DOC Module", p. 6.

Mike Bogdanoff (South Coast Air Quality Management District), "Three Locomotive Demonstration Projects", CARB Locomotive Symposium, Nov. 28, 2007, pp. 1-15.

Mike Iden, (Union Pacific Railroad Company), "From idea to market: technological successes & limitations", CARB Locomotive Symposium, Nov. 28, 2007, pp. 1-11.

Steve Fritz (Southwest Research Institute), "U.S. Locomotive Aftertreatment Retrofit Progress Report: SwRI test Programs," CARB Locomotive Symposium, Nov. 28, 2007, pp. 1-96.

Union Pacific Railroad Company and BNSF Railway, "Diesel Particulate Filter (DPF) Technology for Locomotives in the US and Europe," Dec. 7, 2006, pp. 1-17.

* cited by examiner

EXHAUST SYSTEM HAVING AN AFTERTREATMENT MODULE

TECHNICAL FIELD

The present disclosure is directed to an exhaust system and, more particularly, to an exhaust system having an aftertreatment module.

BACKGROUND

Internal combustion engines, including diesel engines, gasoline engines, gaseous fuel-powered engines, and other engines known in the art exhaust a complex mixture of air pollutants. These air pollutants are composed of gaseous compounds including, among other things, the oxides of nitrogen ($NO_X$). Due to increased awareness of the environment, exhaust emission standards have become more stringent, and the amount of $NO_X$ emitted to the atmosphere by an engine may be regulated depending on the type of engine, size of engine, and/or class of engine.

In order to comply with the regulation of $NO_X$, some engine manufacturers have implemented a strategy called selective catalytic reduction (SCR). SCR is an exhaust treatment process where a reductant, most commonly urea ($(NH_2)_2CO$) or a water/urea solution, is selectively injected into the exhaust gas stream of an engine and adsorbed onto a downstream substrate. The injected urea solution decomposes into ammonia ($NH_3$), which reacts with $NO_X$ in the exhaust gas to form water ($H_2O$) and diatomic nitrogen ($N_2$).

In some applications, the substrate used for SCR purposes may need to be very large to help ensure it has enough surface area or effective volume to adsorb appropriate amounts of the ammonia required for sufficient reduction of $NO_X$. These large substrates can be expensive and require significant amounts of space within the engine's exhaust system. In addition, the substrate must be placed far enough downstream of the injection location for the urea solution to have time to decompose into the ammonia gas and to evenly distribute within the exhaust flow for the efficient reduction of $NO_X$. This spacing may further increase packaging difficulties of the exhaust system.

Exhaust backpressure caused by the use of the SCR substrate described above can be problematic in some situations. In particular, the SCR substrate can restrict exhaust flow to some extent and thereby cause an increase in the pressure of exhaust exiting an engine. If this exhaust back pressure is too high, the breathing ability and subsequent performance of the engine could be negatively impacted. Accordingly, measures should be taken to avoid overly restricting exhaust flow when implementing SCR.

The exhaust systems of many internal combustion engines can also be equipped with noise attenuation devices, such as mufflers. The mufflers are typically located downstream of the SCR substrates to dissipate excessive noise in the exhaust flow exiting the substrates. Although mufflers may help reduce some noise pollution, the inclusion of these serially-located devices often increases a size of the engine's exhaust system and, consequently, the difficulty of exhaust system packaging.

The exhaust system of the present disclosure addresses one or more of the needs set forth above.

SUMMARY

One aspect of the present disclosure is directed to an aftertreatment module. The aftertreatment module may include a plurality of inlets configured to direct exhaust in a first flow direction into the aftertreatment module. The aftertreatment module may also include a mixing duct configured to receive exhaust from the plurality of inlets, and a branching passage in fluid communication with the mixing duct. The branching passage may be configured to redirect exhaust from the mixing duct into separate flows that exit the aftertreatment module in a second flow direction opposite the first flow direction.

A second aspect of the present disclosure is directed to another aftertreatment module. This aftertreatment module may include a plurality of exhaust inlets, and an intermediate flow region having a first flow direction and being configured to receive exhaust from the plurality of inlets. The aftertreatment module may also include a first exhaust treatment device located downstream of the plurality of inlets and upstream of the intermediate flow region, and a passage configured to receive exhaust from the intermediate flow region and direct the exhaust in multiple flow paths at oblique angles relative to the first flow direction. The aftertreatment module may additionally include a second exhaust treatment device located downstream of the passage.

A third aspect of the present disclosure is directed to a power system. The power system may include a combustion engine having a plurality of cylinders, a plurality of exhaust inlets configured to receive exhaust from the plurality of cylinders, and a plurality of oxidation catalysts located downstream of the plurality of inlets. The power system may also include a mixing duct configured to receive exhaust from the plurality of oxidation catalysts, a reductant injector in fluid communication with the mixing duct, and a mixer located within the mixing duct downstream of the reductant injector. The power system may additionally include a first bank of SCR catalysts located radially outward from the mixing duct, configured to receive exhaust from the mixing duct, and angled relative to a longitudinal axis of the mixing duct to discharge exhaust radially inward toward a side of the mixing duct; and a second bank of SCR catalysts located radially outward from the mixing duct and configured to receive exhaust from the mixing duct, configured to receive exhaust from the mixing duct, and angled relative to a longitudinal axis of the mixing duct to discharge exhaust radially inward toward a side of the mixing duct. The power system may further include an outlet chamber surrounding the mixing duct and configured to receive exhaust from the first and second banks of SCR catalysts, and a wall located at an oblique angle relative to a face of the first bank of SCR catalysts that, together with the first bank of SCR catalysts, at least partially forms an exhaust passage having a decreasing flow area along a flow direction.

DETAILED DESCRIPTION

Figure 1:
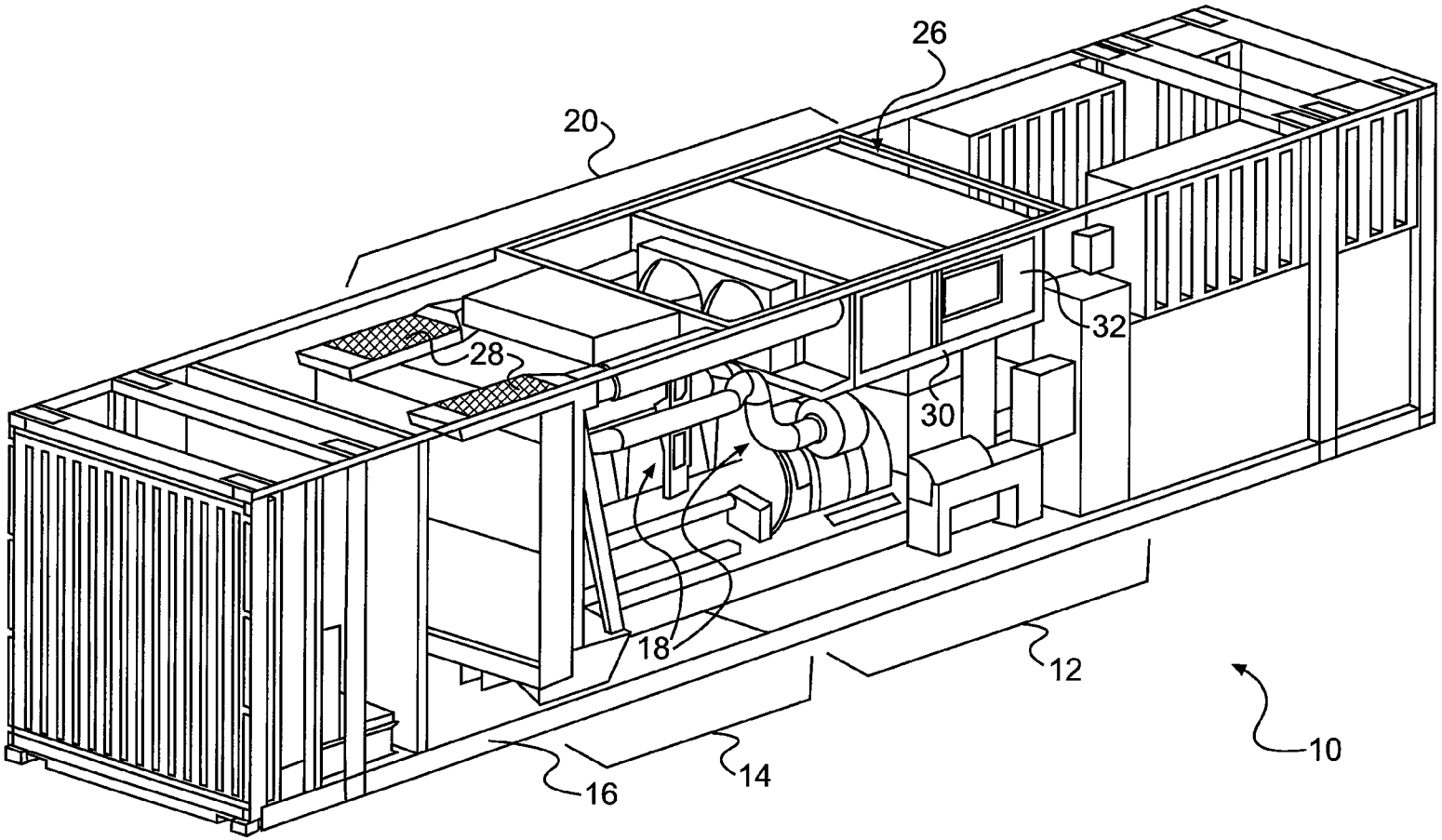
FIG. 1 is a pictorial illustration of an exemplary disclosed power system.

FIG. 1 illustrates an exemplary power system 10. For the purposes of this disclosure, power system 10 is depicted and described as a genset including a generator 12 powered by a multi-cylinder internal combustion engine 14. Generator 12 and engine 14 may be generally contained within and supported by an external frame 16. It is contemplated, however, that power system 10 may embody another type of power system, if desired, such as one including a diesel, gasoline, or gaseous fuel-powered engine associated with a mobile machine such as a locomotive, or a stationary machine such as a pump.

Figure 2:
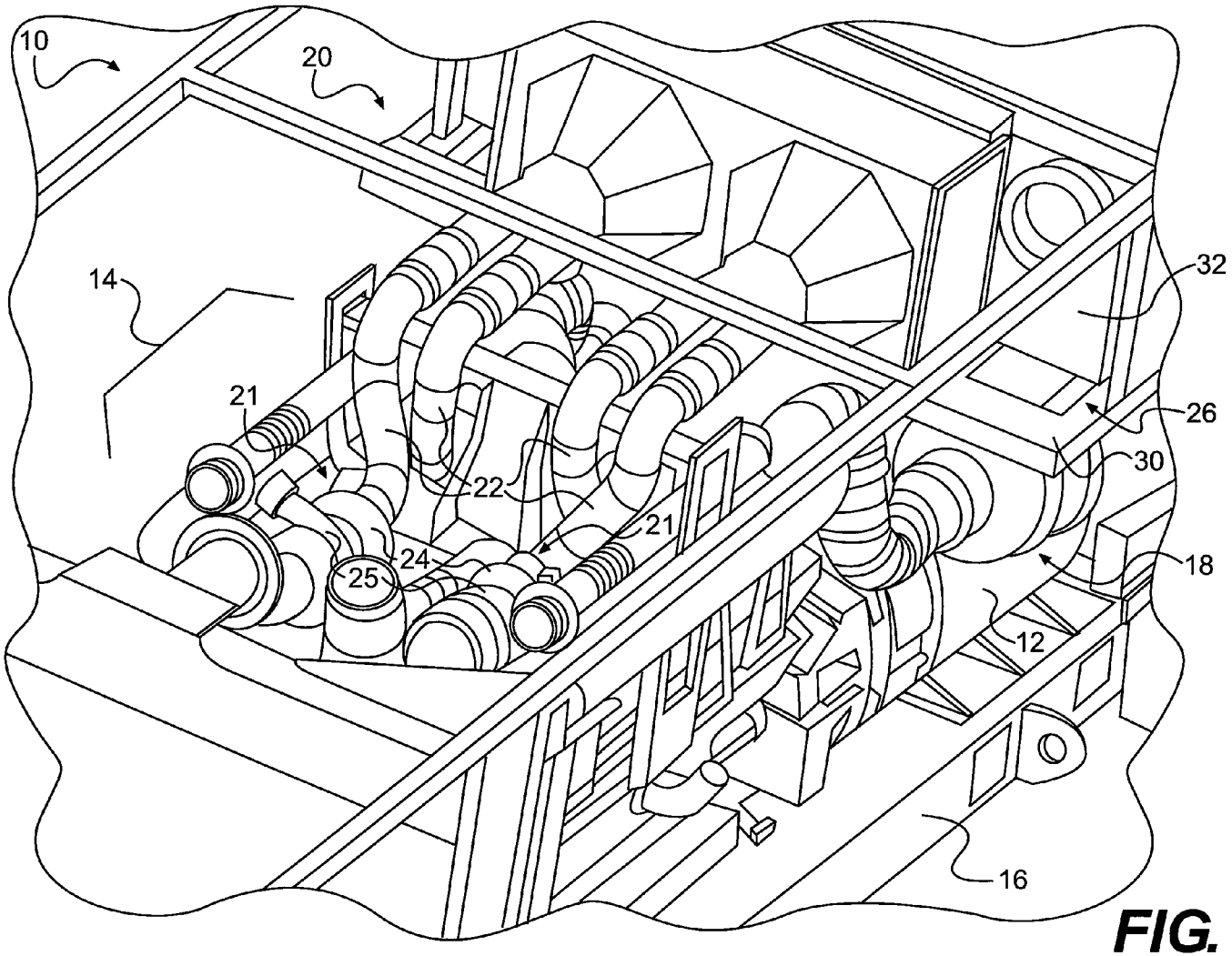
FIG. 2 is a close-up pictorial illustration of the power system of FIG. 1.

Multiple separate sub-systems may be included within power system 10 to promote power production. For example, power system 10 may include, among other things, an air induction system 18 and an exhaust system 20. Air induction system 18 may be configured to direct air or an air/fuel mixture into power system 10 for subsequent combustion. Exhaust system 20 may treat and discharge byproducts of the combustion process to the atmosphere. As shown in FIG. 2, air induction and exhaust systems 18, 20 may be mechanically coupled to each other by way of one or more turbochargers 21.

Exhaust system 20 may include components that condition and direct exhaust from the cylinders of engine 14 to the atmosphere. For example, exhaust system 20 may include one or more exhaust passages 22 fluidly connected to the cylinders of engine 14, one or more turbines 24 driven by exhaust flowing through passages 22, and an aftertreatment module 26 connected to receive and treat exhaust from passages 22 after flowing through turbine 24. As the hot exhaust gases exiting the cylinders of engine 14 move through turbines 24 and expand against vanes (not shown) thereof, turbines 24 may rotate and drive connected compressors 25 of air induction system 18 to pressurize inlet air. Aftertreatment module 26 may treat, condition, and/or otherwise reduce constituents of the exhaust exiting turbines 24 before the exhaust is discharged to the atmosphere via one or more discharge passages 28 (shown only in FIG. 1; removed from FIG. 2 for clarity).

Figure 3:
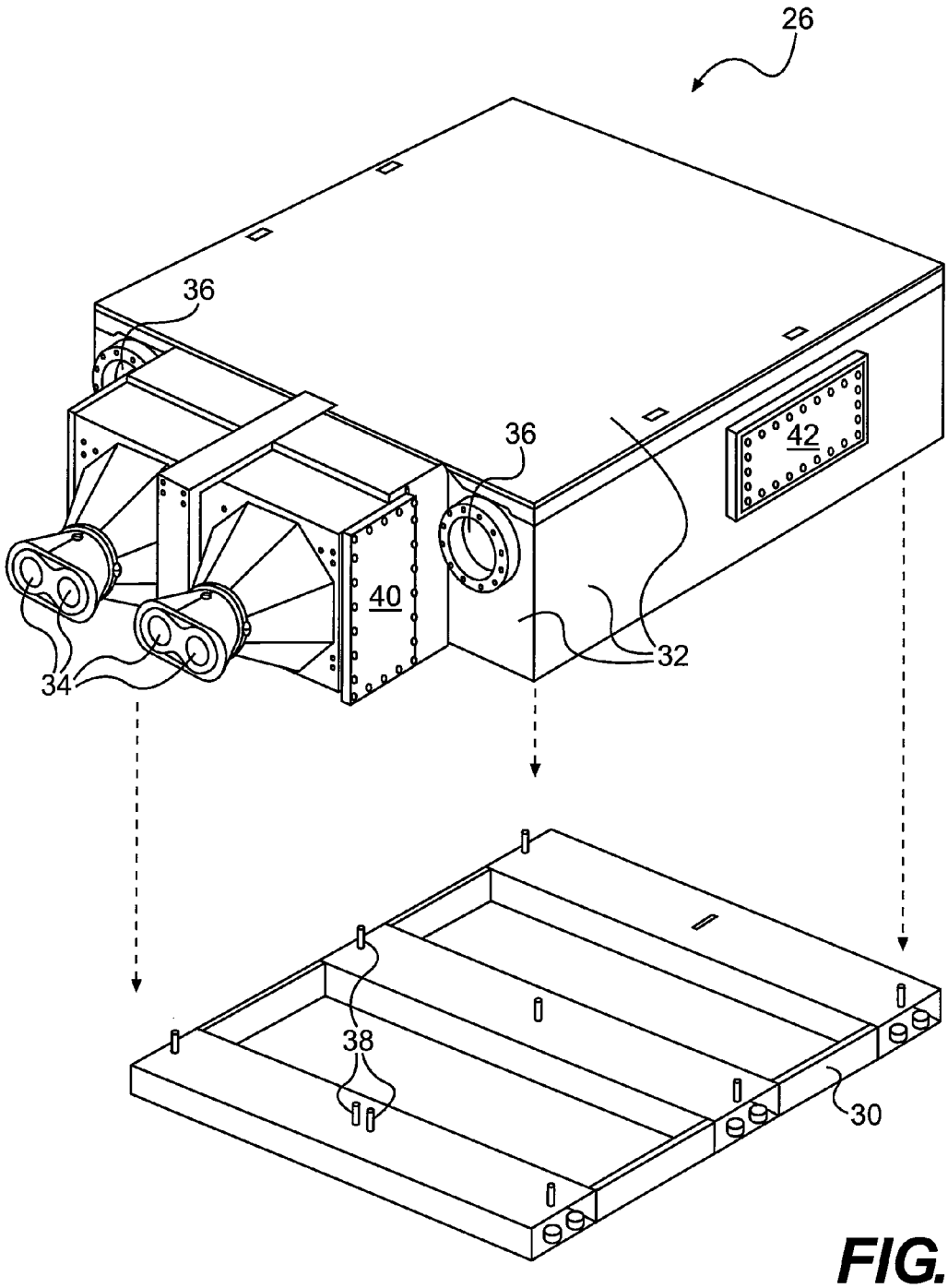
FIG. 3 is a pictorial illustration of an exemplary disclosed aftertreatment module that may be utilized in conjunction with the power system of FIG. 1.

As shown in FIG. 3, aftertreatment module 26 may include a base support 30, a generally box-like housing 32, one or more inlets 34, and one or more outlets 36. Base support 30 may be fabricated from, for example, a mild steel, and rigidly connected to frame 16 of power system 10 (referring to FIGS. 1 and 2). Housing 32 may be fabricated from, for example, welded stainless steel, and connected to base support 30 in such a way that housing 32 can thermally expand somewhat relative to base support 30 when housing 32 is exposed to elevated temperatures. In one embodiment, housing 32 includes oversized bores or slots (not shown) configured to engage, with clearance, fasteners 38 of base support 30. Inlets 34 and outlets 36 may be located at one end of housing 32 such that flows of exhaust may exit housing 32 in a direction opposite flows of exhaust entering housing 32. Inlets 34 may be operatively connected to passages 22 (referring to FIG. 2), while outlets 36 may be operatively connected to passages 28 (referring to FIG. 1). One or more access panels, for example a pair of oxidation catalyst access panels 40 and a pair of SCR catalyst access panels 42, may be located at strategic locations on housing 32 to provide service access to internal components of aftertreatment module 26.

Figure 4:
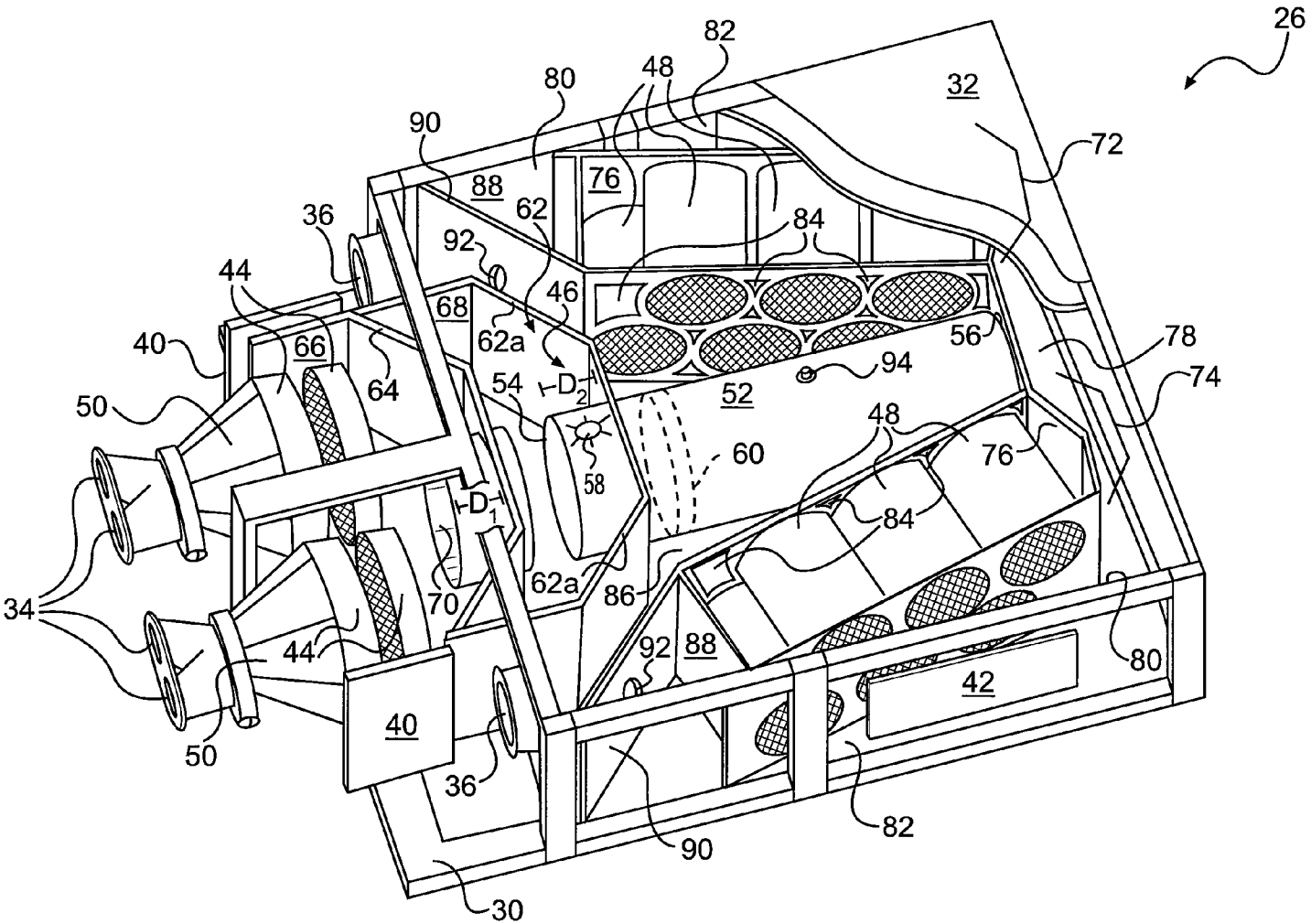
FIG. 4 is a cut-away view illustration of the aftertreatment module of FIG. 3.

Aftertreatment module 26 may house a plurality of exhaust treatment devices. For example, FIG. 4 illustrates aftertreatment module 26 as housing a first aftertreatment device consisting of one or more banks of oxidation catalysts 44, a second aftertreatment device consisting of a reductant dosing arrangement 46, and a third aftertreatment device consisting of one or more banks of SCR catalysts 48. It is contemplated that aftertreatment module 26 may include a greater or lesser number of aftertreatment devices of any type known in the art, as desired. Oxidation catalysts 44 may be located downstream of inlets 34 and, in one embodiment, also downstream of a diffuser 50 associated with pairs of inlets 34. Reductant dosing arrangement 46 may be located downstream of oxidation catalysts 44 and upstream of SCR catalysts 48.

Oxidation catalysts 44 may be, for example, diesel oxidation catalysts (DOC). As DOCs, oxidation catalysts 44 may each include a porous ceramic honeycomb structure, a metal mesh, a metal or ceramic foam, or another suitable substrate coated with or otherwise containing a catalyzing material, for example a precious metal, that catalyzes a chemical reaction to alter a composition of exhaust passing through oxidation catalysts 44. In one embodiment, oxidation catalysts 44 may include palladium, platinum, vanadium, or a mixture thereof that facilitates a conversion of NO to $NO_2$. In another embodiment, oxidation catalysts 44 may alternatively or additionally perform particulate trapping functions (i.e., oxidation catalysts 44 may be a catalyzed particulate trap), hydro-carbon reduction functions, carbon-monoxide reduction functions, and/or other functions known in the art.

In the depicted embodiment, two separate banks of oxidation catalysts 44 are disclosed as being arranged to receive exhaust in parallel from pairs of inlets 34. Each bank of oxidation catalysts 44 may include two or more substrates disposed in series and configured to receive exhaust from one pair of inlets 34 and one associated diffuser 50. In the depicted embodiment, diffuser 50 is configured as a cone or multiple concentric cones, although any diffuser geometry known in the art may be utilized. In the arrangement of FIGS. 1-5, each diffuser 50 may be configured to distribute exhaust received from the pair of inlets 34 in a substantially uniform manner across a face of a leading substrate of the associated bank of oxidation catalysts 44. In one example, a space may exist between substrates of a single bank of oxidation catalysts 44, if desired, the space simultaneously promoting exhaust distribution and sound attenuation. It is contemplated that any number of banks of oxidation catalysts 44 including any number of substrates arranged in series or parallel may be utilized within aftertreatment module 26, as desired.

Reductant dosing arrangement 46 may embody an intermediate flow region comprising, among other things, a mixing duct 52 having an upstream open end 54 in fluid communication with oxidation catalysts 44, and a downstream open end 56 in fluid communication with SCR catalysts 48. A reductant injector 58 may be located at or near upstream open end 54 and configured to inject a reductant into the exhaust flowing through mixing duct 52. A gaseous or liquid reductant, most commonly a water/urea solution, ammonia gas, liquefied anhydrous ammonia, ammonium carbonate, an amine salt, or a hydrocarbon such as diesel fuel, may be sprayed or otherwise advanced into the exhaust passing through mixing duct 52.

Reductant injector 58 may be located a distance upstream of SCR catalysts 48 and at an inlet portion of mixing duct 52 to allow the injected reductant sufficient time to mix with exhaust from power source 10 and to sufficiently decompose before entering SCR catalysts 48. That is, an even distribution of sufficiently decomposed reductant within the exhaust passing through SCR catalysts 48 may enhance $NO_X$ reduction therein. The distance between reductant injector 58 and SCR catalysts 48 (i.e., the length of mixing duct 52) may be based on a flow rate of exhaust exiting power system 10 and/or on a cross-sectional area of mixing duct 52. In the example depicted in FIGS. 4 and 5, mixing duct 52 may extend a majority of a length of housing 32, with reductant injector 58 being located at upstream open end 54.

To enhance incorporation of the reductant with exhaust, a mixer 60 may be located within mixing duct 52. In one embodiment, mixer 60 is located downstream of reductant injector 58 and may include vanes or blades inclined to generate a swirling motion of the exhaust as it flows through mixing duct 52.

In one embodiment, an attenuation chamber 62 may fluidly connect an outlet of oxidation catalysts 44 with upstream open end 54 of mixing duct 52. In the example illustrated in FIGS. 4 and 5, attenuation chamber 62 may have downstream side walls 62*a* that slope toward upstream open end 54 of mixing duct 52 to funnel exhaust into mixing duct 52. Attenuation chamber 62 may also include a partition 64, in some embodiments, that divides attenuation chamber 62 into serially-arranged first and second compartments 66, 68. A tube 70 may fluidly connect first compartment 66 to second compartment 68. To enhance attenuation of sound within first and second compartments 66, 68, tube 70 may extend into first compartment 66 a distance $D_1$ about equal to one-half a distance from a trailing substrate of oxidation catalysts 44 to partition 64, and mixing duct 52 may likewise extend into second compartment 68 a distance $D_2$ about equal to one-half a distance from partition 64 to a downstream end wall 62*b* of attenuation chamber 62. In one example, a total length of tube 70 may be about twice the distance $D_1$.

Figure 5:
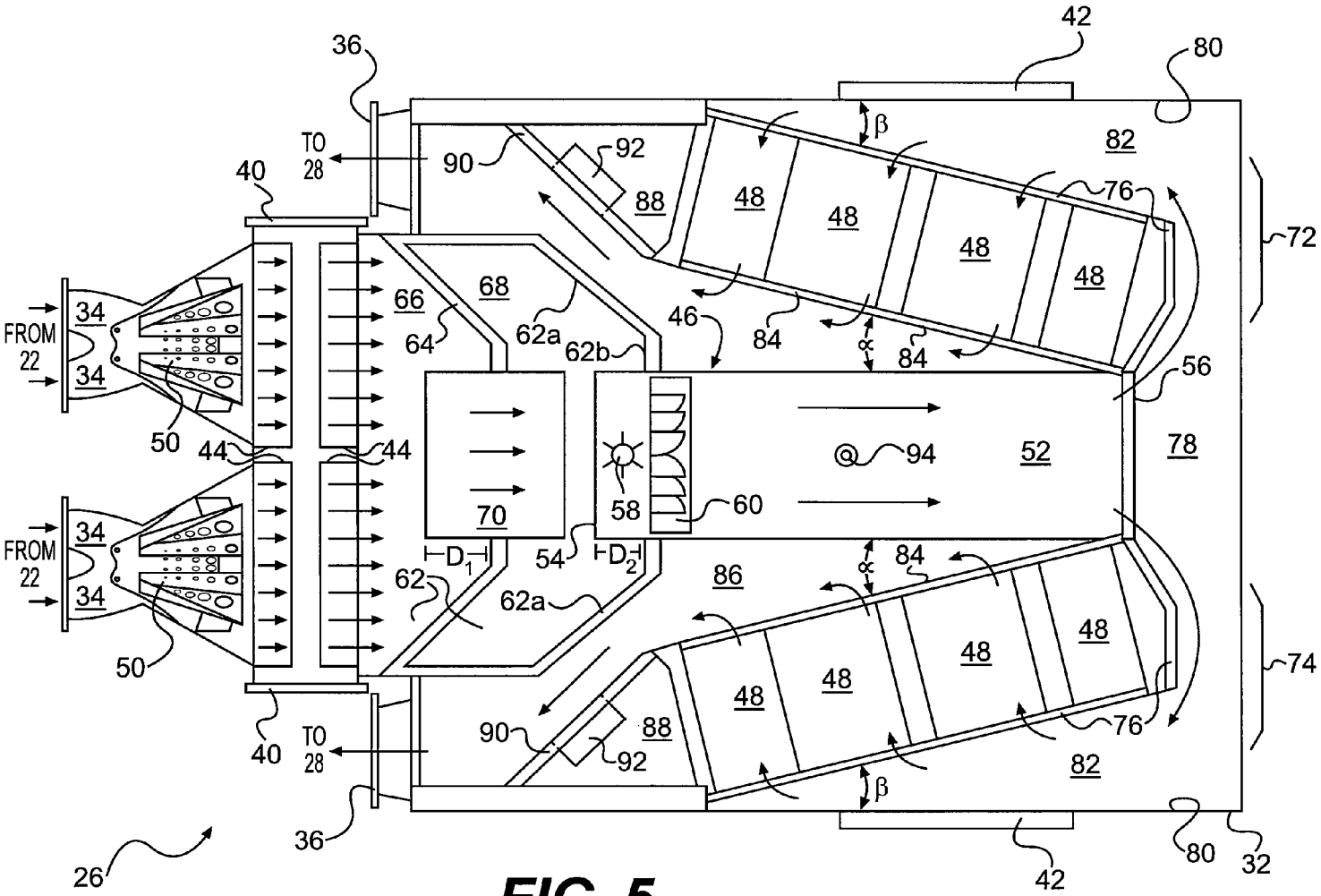
FIG. 5 is a cross-sectional view illustration of the aftertreatment module of FIG. 3.

Aftertreatment module 26 may include first and second banks 72, 74 of SCR catalysts 48, each of first and second banks 72, 74 including a plurality of SCR catalysts 48 arranged in parallel relative to each other. In the embodiment of FIGS. 4 and 5, each of first and second banks 72, 74 includes six SCR catalysts 48 co-mounted within a common support structure 76. It is contemplated, however, that any number of SCR catalysts 48 may be included within aftertreatment module 26 and supported within any number of banks.

Each of first and second banks 72, 74 of SCR catalysts 48 may be located radially outward of mixing duct 52, and positioned at an oblique acute interior angle $\alpha$ (shown only in FIG. 5) relative to a longitudinal axis of mixing duct 52. In one example, angle $\alpha$ may be in the range of about 10-45°. A passage 78 located at an end of housing 32 opposite inlets 34 may branch and redirect exhaust exiting mixing duct 52 radially outward toward opposing side walls 80 of housing 32. Each side wall 80 may be located at an oblique acute interior angle $\beta$ (shown only in FIG. 5) relative to an upstream face of an associated one of first and second banks 72, 74 of SCR catalysts 48 such that each side wall 80, together with the associated one of first and second banks 72, 74 of SCR catalysts 48, may form a passage 82 that extends from an upstream one of SCR catalysts 48 to a downstream one of SCR catalysts 48 and that has a decreasing cross-sectional area along a flow direction. In one example, angle $\beta$ may be in the range of 10-45°. The decreasing cross-sectional area of passage 82 may generate an increasing restriction on the flow of exhaust passing therethrough that results in substantially equal distribution of exhaust to all of SCR catalysts 48.

Each SCR catalyst 48 may be substantially identical in shape, size, and composition. In particular, each SCR catalyst 48 may include a generally cylindrical substrate fabricated from or otherwise coated with a ceramic material such as titanium oxide; a base metal oxide such as vanadium and tungsten; zeolites; and/or a precious metal. With this composition, decomposed reductant entrained within the exhaust flowing through mixing duct 52 and passages 78, 82 may be adsorbed onto the surface and/or absorbed within of each SCR catalyst 48, where the reductant may react with NOx (NO and $NO_2$) in the exhaust gas to form water ($H_2O$) and diatomic nitrogen ($N_2$).

In addition to supporting SCR catalysts 48, support structure 76 may also be utilized to attenuate noise. Specifically, each support structure 76 may include one or more attenuation cavities 84 formed between SCR catalysts 48 of a single one of first and second banks 72, 74. Each of attenuation cavities 84 may have a first end closed at an upstream side of the respective bank 72, 74 of SCR catalysts 48, and a second end open at a downstream side of the respective bank 72, 74. In this configuration, sound from downstream of SCR catalysts 48 may enter attenuation cavities 84, reverberate therein, and dissipate, without allowing untreated exhaust to pass around SCR catalysts 48.

Housing 32, together with first and second banks 72, 74 of SCR catalysts 48 and end walls 62*a* of attenuation chamber 62, may form an outlet chamber 86 that annularly surrounds mixing duct 52. In one embodiment, a space may be maintained around an entire periphery of mixing duct 52 such that outlet chamber 86 may receive and join radial-inwardly directed exhaust flows from all SCR catalysts 48 of both first and second banks 72, 74. Outlet chamber 52 may then redivide the exhaust into two separate flows that are discharged from aftertreatment module 26 via outlets 36.

An exit attenuation chamber 88 may be located downstream of outlet chamber 86 and proximal each outlet 36. Each exit attenuation chamber 88 may be at least partially formed by a portion of side wall 80, an end of support structure 76, and a wall 90 disposed at an angle between side wall 80 and support structure 76. In the embodiment depicted in FIGS. 4 and 5, each exit attenuation chamber 88 may have a generally triangular cross section such that space usage within aftertreatment module 26 may be increased. It should be noted, however, that attenuation chamber 88 may include another shape, if desired. A separate passage 92 may extend a distance into each exit attenuation chamber 88 to fluidly communicate each exit attenuation chamber 88 with an exiting flow of exhaust, the extension distance being selected to enhance noise attenuation.

A NOx sensor 94 may be situated to detect a NOx concentration in the exhaust exiting SCR catalysts 48. In one example, NOx sensor 94 may be in fluid communication with outlet chamber 86 such that the concentration of NOx in all flows of exhaust passing through aftertreatment module 26 may be monitored. For example, NOx sensor 94 may be located on an outer surface of mixing duct 52. NOx sensor 94 may generate a signal indicative of the concentration of NOx within the exhaust passing through outlet chamber 86, and direct the signal to an exhaust or power system controller (not shown). The controller may then responsively adjust parameters of engine and/or aftertreatment operation including adjusting the amount of reductant being injected, such that the concentration of NOx is maintained below regulated limits. It is contemplated that NOx sensor 94 may alternatively be located upstream of SCR catalysts 48, for example on an inner surface of mixing duct 52, if desired.

FIG. 5 illustrates exhaust flow throughout aftertreatment module 26. FIG. 5 will be discussed in more detail in the following section to further illustrate the disclosed aftertreatment module and its operation.

INDUSTRIAL APPLICABILITY

The aftertreatment module of the present disclosure may be applicable to any power system configuration requiring exhaust constituent conditioning, where component packaging, backpressure, and noise attenuation are important issues. The disclosed aftertreatment module may improve packaging by utilizing multiple small reduction devices and by efficiently using available space for multiple purposes (e.g., for constituent reduction and noise attenuation), while still providing adequate reductant decomposition spacing and evenly distributing exhaust flow and reductant across appropriate catalysts. The disclosed aftertreatment module may also maintain low back pressure by limiting exhaust flow restriction. Operation of power system 10 will now be described.

Referring to FIGS. 1 and 2, air induction system 18 may pressurize and force air or a mixture of fuel and air into the cylinders of engine 14 for subsequent combustion. The fuel and air mixture may be combusted by engine 14 to produce a mechanical rotation that drives generator 12 and an exhaust flow of hot gases. The exhaust flow may contain a complex mixture of air pollutants, which can include, among other things, the oxides of nitrogen ($NO_X$). The exhaust may be directed through turbines 24 and passages 22 to aftertreatment module 26.

The exhaust may flow from passages 22 into aftertreatment module 26 via four different inlets 34. Inlets 34 may be paired together such that flow from two inlets 34 passes through a single common diffuser 50 to an associated banks of oxidation catalysts 44. Diffusers 50 may help to evenly distribute incoming exhaust across the faces of oxidation catalysts 44. As the exhaust passes through oxidation catalysts 44, some of the NO within the exhaust may be converted to $NO_2$. Alternatively or additionally, particulate matter, hydrocarbons, and/or carbon monoxide may be trapped, converted, and/or reduced within oxidation catalysts 44.

After passing through oxidation catalysts 44, the exhaust may flow into first compartment 66 of attenuation chamber 62, through tube 70, and into second compartment 68. As the exhaust passes through first and second compartments 66, 68, sound associated with the flow may reverberate therein and dissipate. The extension of tube 70 and mixing duct 52 into first and second compartments 66, 68, respectively, may enhance the attenuation effects of first and second compartments 66, 68.

Exhaust exiting second compartment 66 may be funneled into mixing duct 52, where swirl and/or turbulence of the exhaust may be promoted by mixer 60. Reductant may be injected into the flow upstream of mixer 60. As the swirling and/or turbulent flow of exhaust and reductant passes along the length of mixing duct 52, the mixture may continue to homogenize and the reductant may begin to decompose. By the time the mixture reaches SCR catalysts 48, the bulk of the reductant should be decomposed for reduction purposes within SCR catalysts 48.

Passage 78 may redirect exhaust from mixing duct 52 radially-outward toward side walls 80 of housing 32 and into parallel passages 82. Because of the decreasing flow area of passages 82, the exhaust may be forced through all of SCR catalysts 48 in a substantially uniform manner. As the exhaust passes through SCR catalysts 48, NOx may react with the reductant and be reduced to water and diatomic nitrogen. The exhaust may exit SCR catalysts 48 into outlet chamber 86. Because of a clearance space maintained between a periphery of mixing duct 52 and walls of housing 32, the exhaust exiting SCR catalysts 48 from separate banks 72, 74 may be rejoined within outlet chamber 86. The NOx concentration of the exhaust mixture rejoined within outlet chamber 86, may be detected by NOx sensor 94.

Noise associated with the flow of exhaust in aftertreatment module 26 may be attenuated both as the exhaust flow enters and exits outlet chamber 86. In particular, noise may be allowed to enter attenuation cavities 84 from the downstream side of SCR catalysts 48, and reverberate and dissipate within attenuation cavities 84. In addition, just before the exhaust is discharged from aftertreatment module 26 via outlets 36, noise associated with the discharging flow of exhaust may enter into chambers 88, where the noise may again reverberate and be dissipated. The exhaust may then be discharged from the same end of aftertreatment module 26 as it originally entered aftertreatment module 26 and in an opposite direct.

Aftertreatment module 26 may promote even exhaust distribution and sufficient reductant decomposition. For example, diffusers 50 may help to distribute exhaust evenly across the face of upstream oxidation catalysts 44. The spacing between upstream and downstream oxidation catalysts 44 may further promote distribution. In addition, mixer 60 may help mix exhaust with reductant through swirling and/or turbulence, and the length of mixing duct 52 and passage 78 may be sufficient for appropriate amounts of mixing and reductant decomposition. The location, number, and orientation of SCR catalysts 48 relative to side walls 80 and mixing duct 52 may promote even distribution of exhaust across the faces of SCR catalysts 48. In addition, the parallel arrangement of multiple oxidation and SCR catalysts 44, 48 may result in little restriction on the exhaust flow through aftertreatment module 26, thereby improving engine backpressure and performance.

Aftertreatment module 26 may include few, if any, dedicated passage walls, thus reducing cost. That is, most components of aftertreatment module 26 may perform multiple functions, including acting as passage walls that channel exhaust flows in desired directions. For example, attenuation chamber 62 may be utilized to both attenuate noise and to funnel exhaust towards mixing duct 52. In another example, mixing duct 52 may be utilized to both mix exhaust with reductant, and direct exhaust from oxidation catalysts 44 towards SCR catalysts 48. Similarly, SCR catalysts 48 may be utilized to treat exhaust and as a wall of a restricted passage that causes exhaust to be evenly distributed across all of SCR catalysts 48. And finally, attenuation chamber 88 may make use of otherwise wasted space to dissipate noise. The simplicity and multi-use functionality of the components of aftertreatment module 26 may lower the cost thereof.

It will be apparent to those skilled in the art that various modifications and variations can be made to the exhaust system and aftertreatment module of the present disclosure without departing from the scope of the disclosure. Other embodiments will be apparent to those skilled in the art from consideration of the specification and practice of the system and module disclosed herein. It is intended that the specification and examples be considered as exemplary only, with a true scope of the disclosure being indicated by the following claims and their equivalent.

What is claimed is:

1. An aftertreatment module, comprising:

a plurality of inlets configured to direct exhaust in a first flow direction into the aftertreatment module;

a mixing duct configured to receive exhaust from the plurality of inlets;

a branching passage in fluid communication with the mixing duct and configured to redirect exhaust from the mixing duct into separate flows that exit the aftertreatment module in a second flow direction opposite the first flow direction;

a bank of SCR catalysts; and a wall located at an oblique angle relative to a face of the bank of SCR catalysts that, together with the bank of SCR catalysts, at least partially forms an exhaust passage having a decreasing flow area along a flow direction.

2. The aftertreatment module of claim 1, wherein the bank of SCR catalysts is a first bank of SCR catalysts, the after treatment module further including:

an outlet chamber surrounding the mixing duct and configured to receive exhaust from the first bank of SCR catalysts and a second banks of SCR catalysts, wherein the first bank of SCR catalysts is located radially outward from the mixing duct and configured to receive exhaust from the mixing duct; and the second bank of SCR catalysts is located radially outward from the mixing duct and configured to receive exhaust from the mixing duct.

3. The aftertreatment module of claim 2, further including a sensor located to detect an exhaust constituent concentration within the outlet chamber.

4. The aftertreatment module of claim 1, wherein the bank of SCR catalysts is angled relative to a longitudinal axis of the mixing duct and configured to discharge exhaust radially inward toward the mixing duct.

5. The aftertreatment module of claim 1, further including:

a plurality of attenuation cavities formed between SCR catalysts of the bank of SCR catalysts, each of the plurality of attenuation cavities having a first end closed at an upstream side of the bank of SCR catalysts and a second end open at a downstream side of the bank of SCR catalysts.

6. The aftertreatment module of claim 1, further including a plurality of outlets located downstream of the mixing duct.

7. The aftertreatment module of claim 6, further including a plurality of separate outlet attenuation chambers, each of the plurality of separate outlet attenuation chambers having a single opening in fluid communication with one of the plurality of outlets.

8. The aftertreatment module of claim 1, further including at least one oxidation catalyst located upstream of the mixing duct.

9. The aftertreatment module of claim 8, further including at least one diffuser located proximal at least one of the plurality of inlets and configured to distribute exhaust across the at least one oxidation catalyst.

10. The aftertreatment module of claim 9, wherein the at least one oxidation catalyst includes a plurality of banks of oxidation catalysts, the at least one diffuser includes a plurality of diffusers, and each bank of the plurality of banks of oxidation catalysts is associated with one of the plurality of diffusers.

11. The aftertreatment module of claim 1, further including:

an attenuation chamber located between the plurality of inlets and the mixing duct;

a wall disposed within the attenuation chamber and partitioning the attenuation chamber into first and second compartments; and a tube fluidly communicating the first compartment with the second compartment.

12. The aftertreatment module of claim 1, further including a reductant injector located at an inlet of the mixing duct.

13. An aftertreatment module, comprising:

a plurality of exhaust inlets;

an intermediate flow region having a first flow direction and being configured to receive exhaust from the plurality of inlets;

a first exhaust treatment device located downstream of the plurality of inlets and upstream of the intermediate flow region;

a passage configured to receive exhaust from the intermediate flow region and direct the exhaust in multiple flow paths at oblique angles relative to the first flow direction;

a second exhaust treatment device located downstream of the passage including a bank of SCR catalysts configured to receive exhaust from the intermediate flow region; and a plurality of attenuation cavities formed between SCR catalysts of the bank of SCR catalysts, each of the plurality of attenuation cavities having a first end closed at an upstream side of the bank of SCR catalysts and a second end open at a downstream side of the bank of SCR catalysts.

14. The aftertreatment module of claim 13, wherein the first exhaust treatment device includes at least one oxidation catalyst.

15. The aftertreatment module of claim 13, further including a reductant injector located at an inlet portion of the intermediate flow region.

16. The aftertreatment module of claim 13, further including at least one diffuser located proximal at least one of the plurality of inlets and configured to distribute exhaust across the first exhaust treatment device.

17. A power system, comprising:

a combustion engine having a plurality of cylinders;

a plurality of exhaust inlets configured to receive exhaust from the plurality of cylinders;

a plurality of oxidation catalysts located downstream of the plurality of inlets;

a mixing duct configured to receive exhaust from the plurality of oxidation catalysts;

a reductant injector in fluid communication with the mixing duct;

a mixer located within the mixing duct downstream of the reductant injector;

a first bank of SCR catalysts located radially outward from the mixing duct, configured to receive exhaust from the mixing duct, and angled relative to a longitudinal axis of the mixing duct to discharge exhaust radially inward toward a side of the mixing duct;

a second bank of SCR catalysts located radially outward from the mixing duct and configured to receive exhaust from the mixing duct, configured to receive exhaust from the mixing duct, and angled relative to a longitudinal axis of the mixing duct to discharge exhaust radially inward toward a side of the mixing duct;

an outlet chamber surrounding the mixing duct and configured to receive exhaust from the first and second banks of SCR catalysts; and a wall located at an oblique angle relative to a face of the first bank of SCR catalysts that, together with the first bank of SCR catalysts, at least partially forms an exhaust passage having a decreasing flow area along a flow direction.

* * * * *